US006523691B2

(12) United States Patent
Raj et al.

(10) Patent No.: US 6,523,691 B2
(45) Date of Patent: Feb. 25, 2003

(54) CHILD RESISTANT CLOSURE

(76) Inventors: Balbir Raj, 10 Mendip Crescent, Bedford, MK41 9EP (GB); Ian Jobling, 14 Harrold Priory, Bedford, MK41 0SD (GB); Gurmej Kaur, 10, Mendip Crescent Putnoe, Bedford MK41 9E9 (GB)

( * ) Notice: Subject to any disclaimer, the term of this patent is extended or adjusted under 35 U.S.C. 154(b) by 0 days.

(21) Appl. No.: 09/827,181

(22) Filed: Apr. 6, 2001

(65) Prior Publication Data

US 2001/0017273 A1 Aug. 30, 2001

(51) Int. Cl.[7] ..... B65D 83/04
(52) U.S. Cl. ..... 206/538; 206/536; 206/1.5
(58) Field of Search ..... 206/535, 536, 206/538, 539, 530, 531, 532, 534.1, 534.2, 528, 1.5

(56) References Cited

U.S. PATENT DOCUMENTS

| | | | | | |
|---|---|---|---|---|---|
| 625,757 | A | * | 5/1899 | Groneman | 206/535 |
| 2,687,211 | A | * | 8/1954 | Sparks | 206/539 |
| 3,182,789 | A | * | 5/1965 | Sparks | 206/536 |
| 3,397,671 | A | * | 8/1968 | Hartman, Jr. et al. | 116/308 |
| 3,429,426 | A | * | 2/1969 | Wolf et al. | 206/531 |
| 3,921,804 | A | * | 11/1975 | Tester | 206/515 |
| 3,949,932 | A | * | 4/1976 | Shore | 206/321 |
| RE29,705 | E | | 7/1978 | Compere | |
| 4,120,400 | A | * | 10/1978 | Kotyuk | 206/1.5 |
| 4,192,422 | A | | 3/1980 | Kotyuk | |
| 4,254,871 | A | | 3/1981 | Poore | |
| 4,485,915 | A | | 12/1984 | Berghahn | |
| 4,848,582 | A | | 7/1989 | Levasseur | |
| 5,129,527 | A | | 7/1992 | Lataix | |
| 5,244,091 | A | | 9/1993 | Tannenbaum | |
| 5,323,907 | A | | 6/1994 | Kalvelage | |
| 5,325,968 | A | | 7/1994 | Sowden | |
| 5,489,025 | A | * | 2/1996 | Romick | 206/531 |
| 5,529,188 | A | | 6/1996 | Coggswell | |
| 5,878,887 | A | | 3/1999 | Parker et al. | |
| 5,915,559 | A | | 6/1999 | Hulick et al. | |
| 6,021,901 | A | | 2/2000 | Wolfe | |
| 6,173,838 | B1 | | 1/2001 | Brozell | |

FOREIGN PATENT DOCUMENTS

| | | |
|---|---|---|
| WO | 9901101 | 6/1998 |

* cited by examiner

*Primary Examiner*—Mickey Yu
*Assistant Examiner*—Jila M Mohandesi
(74) *Attorney, Agent, or Firm*—Ralph A. Dowell

(57) ABSTRACT

A child-resistant unit does holder includes a blister pack having a plurality of protrusions formed in a sheet and a unit dose disposed in each of the protrusions. The pack is slidably received in a sleeve which covers the protrusions to prevent a unit dose being dispensed from the pack. A releasable detent mechanism prevents slidable removal of the pack from the sleeve, and at least one of the protrusions forms a detent of the detent mechanism.

15 Claims, 7 Drawing Sheets

CHILD RESISTANT CLOSURE

BACKGROUND OF THE INVENTION

1. Field of the Invention

This invention relates to child resistant closures primarily but not exclusively for blister packs for medicaments.

2. Description of the Related Art

Many medicaments are packaged in blister packs comprising a plurality of deformable protrusions formed in a flexible sheet. Unit doses of medicament are received in the protrusions which are sealed by a frangible film. To remove a unit dose, the unit dose is pushed through the frangible film. The arrangement is very convenient and widely used. Unfortunately it is also easy for unsupervised children to poison themselves by removing the unit dosages and ingesting them.

The invention seeks to render this kind of product more child resistant.

In U.S. Pat. No. 5,878,887 a blister card is received in a tray having a slidable cover. The cover has a tab with a locking projection that engages a slot in the tray. The pack can be partially opened by sliding the cover until the projection is at the end of the slot, and then flexing the tab upwardly to release the locking projection from the slot. This allows the cover to slide to an open position permitting access to the blister card.

In U.S. Pat. No. 5,473,371 a blister pack is folded in two and locked in the folded position by a locking member. To access the pack, the locking member is manually flexed to disengage a locking tab from the notches in the pack so that the locking member can be slidably disengaged from the pack. The pack can then be unfolded to provide access to the unit doses.

Providing a blister pack with a cover or sleeve that can be slidably removed only after releasing a locking mechanism reduces the risk of a child removing a unit dose without supervision. However the products described in the above US patents are generally complex and there is a need for a more reliable and robust childproof locking mechanism which does not add unduly to the cost of a blister pack and which is of a less complex design.

SUMMARY OF THE INVENTION

According to one aspect of the present invention there is provided a child-resistant unit dose holder comprising: a pack having a plurality of protrusions formed in a sheet, and a unit dose disposed in each of the protrusions; a sleeve for slidably receiving the pack, the sleeve covering the protrusions to prevent a unit dose being dispensed from the pack; and a releasable detent mechanism preventing slidable removal of the pack from the sleeve, at least one of the protrusions forming a detent of the detent mechanism.

By using one or more of the protrusions as a detent of the detent mechanism, a less complex and more reliable detent mechanism is provided.

According to another aspect of the present invention there is provided a child-resistant unit dose holder comprising: a pack having a plurality of protrusions formed in a sheet, each of the protrusions containing a unit dose and being spaced inwardly from opposed edges of the sheet; a sleeve for slidably receiving the pack, the sleeve comprising a flexible planar member having a pair of opposed inwardly extending flanges forming a slot for receiving the opposed edges of the strip, and a releasable detent mechanism preventing slidable removal of the pack from the sleeve, the detent mechanism being released in response to flexing of the planar member in a predetermined direction.

DESCRIPTION OF THE DRAWINGS

By way of example only, several embodiments of the invention will be described by reference to the accompanying figures of which.

DESCRIPTION OF THE PREFERRED EMBODIMENTS

Figure 1:
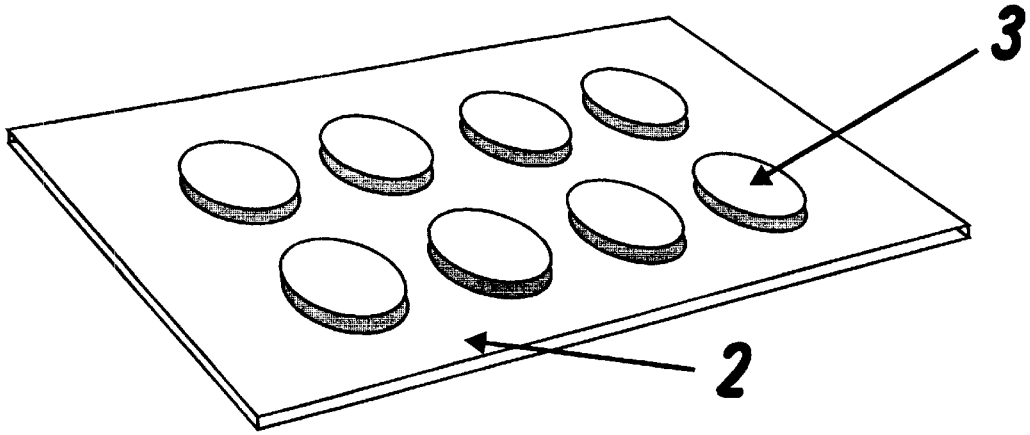
FIG. 1 is a perspective view of a blister pack.
Figure 2:
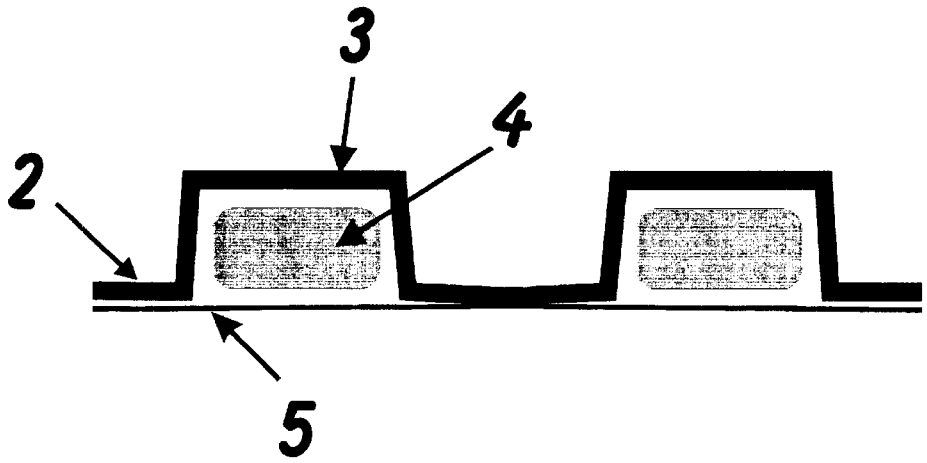
FIG. 2 is a diagrammatic sectional view of the blister pack.

Referring to these drawings, a conventional blister pack (FIGS. 1 & 2) comprises a flexible sheet 2 having a plurality of protrusions 3 formed therein. Unit dose 4 of medicament is received in at least some protrusions. Frangible film 5 extends over the sheet 2 sealing the unit dosage in the protrusions. Frangible film 5 may be heat sealed or glued to the sheet 2. Unit dose 4 is removed by pressing the top of protrusion 3 to rupture the frangible film 5 where it overlies the protrusion. This arrangement is conventional and indeed the invention is useful on conventional blister packs.

Figure 3:
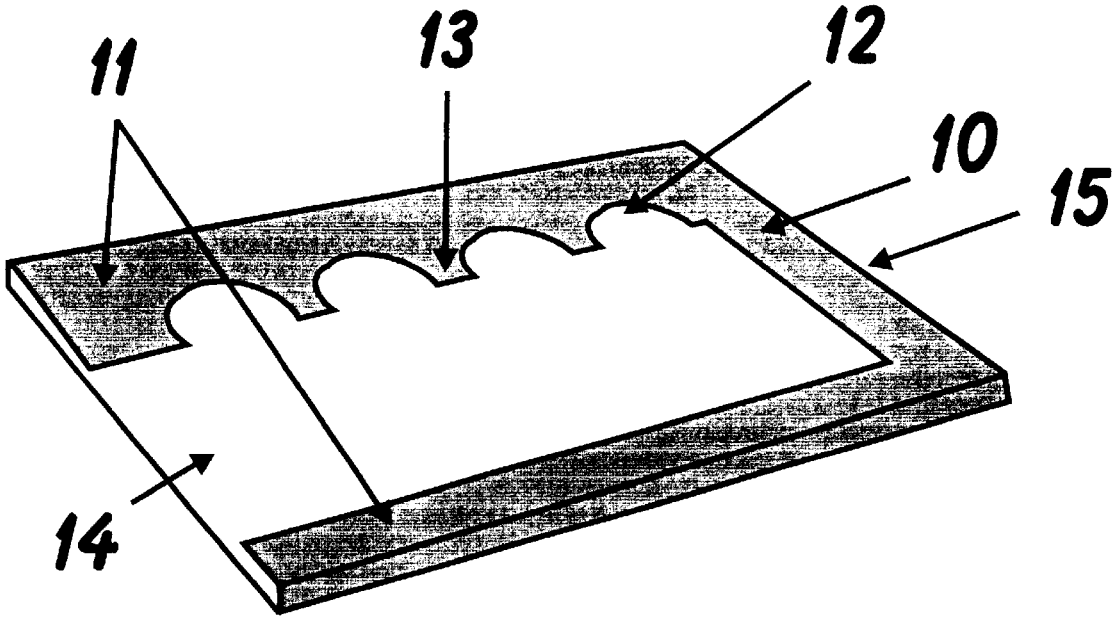
FIG. 3 is a perspective view of a sleeve for slidably receiving the blister pack.
Figure 4:
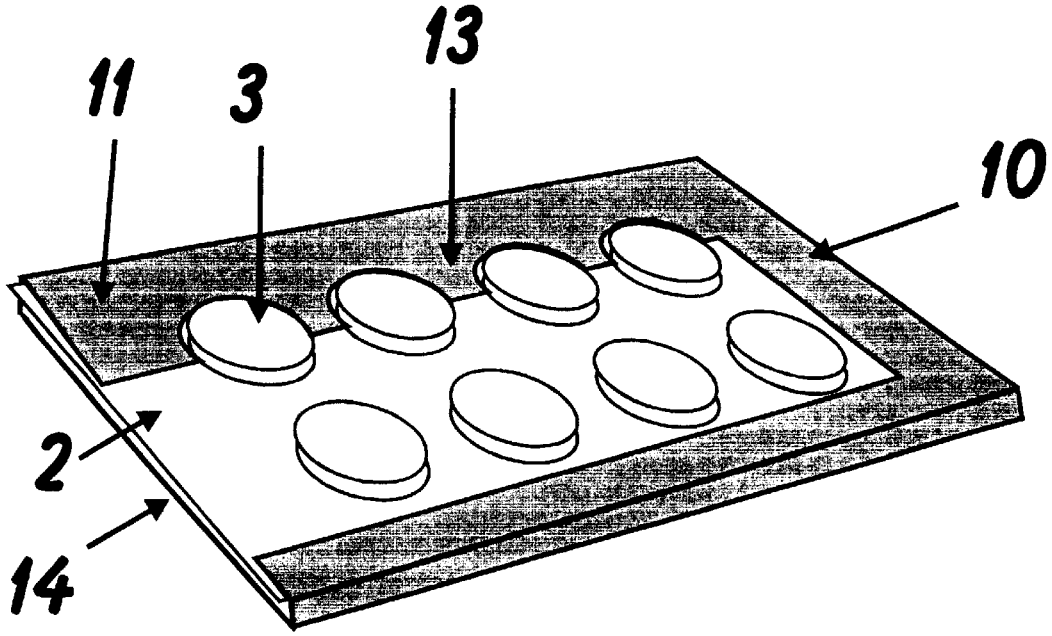
FIG. 4 shows the sleeve with the blister pack inserted.

A flexible sleeve 15 (FIG. 3) is provided for use with such a blister pack. Sleeve 15 can be formed of a plastics material, but could be a card or a card faced with plastics material. It comprises a planar sheet 14 having pair of longitudinal flanges 11 extending inwardly from opposed sides to define a slot for receiving the blister pack. Sheet 14 is of slightly greater width than the sheet 2 of the blister pack so that the blister pack can be slidingly received in the sleeve as shown in FIG. 4. An additional transverse flange 10 closes the sleeve 15 at one end. This increases the childproof properties of the assembly since it is only possible to slide the blister pack out from one end of the sleeve.

Figure 5:
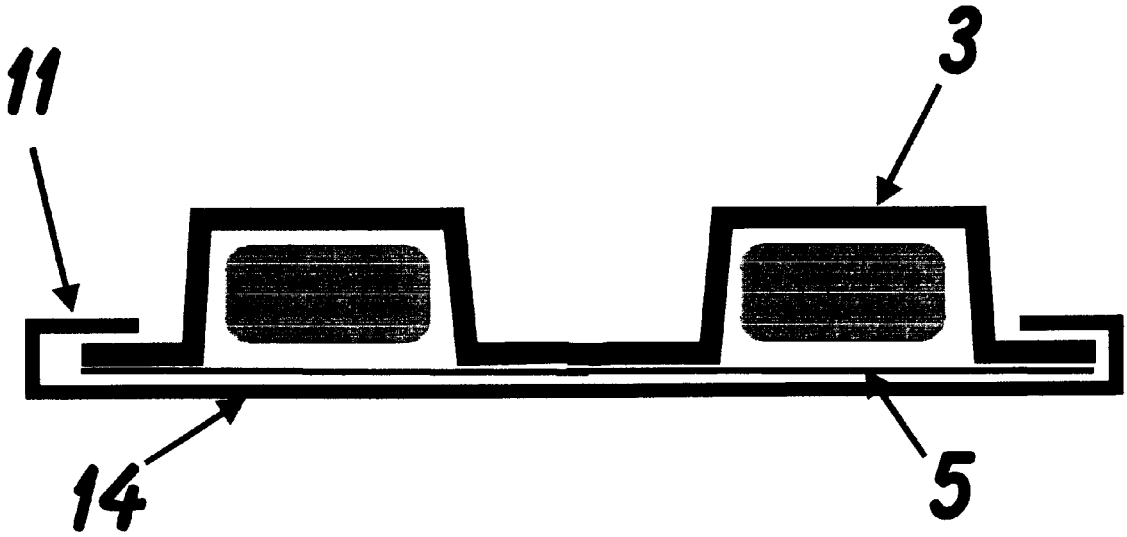
FIG. 5 is a diagrammatic transverse sectional view through the assembly of FIG. 4 taken on a line through the unit doses.

Once the blister pack is received in the sleeve, the flanges 11 of the sleeve extend part way across the sheet 2 of the blister pack. Cut-outs 12 in the flanges 11 are dimensioned and positioned such that ears or projections 13 formed between the cut-outs engage the protrusions 3 on one side of the blister pack (FIG. 4). At best seen in FIG. 5, with the blister pack received in sleeve 15, the planar sheet 14 of the sleeve covers the frangible film 5 of the blister pack so that access to the unit doses 4 is prevented.

Figure 6:
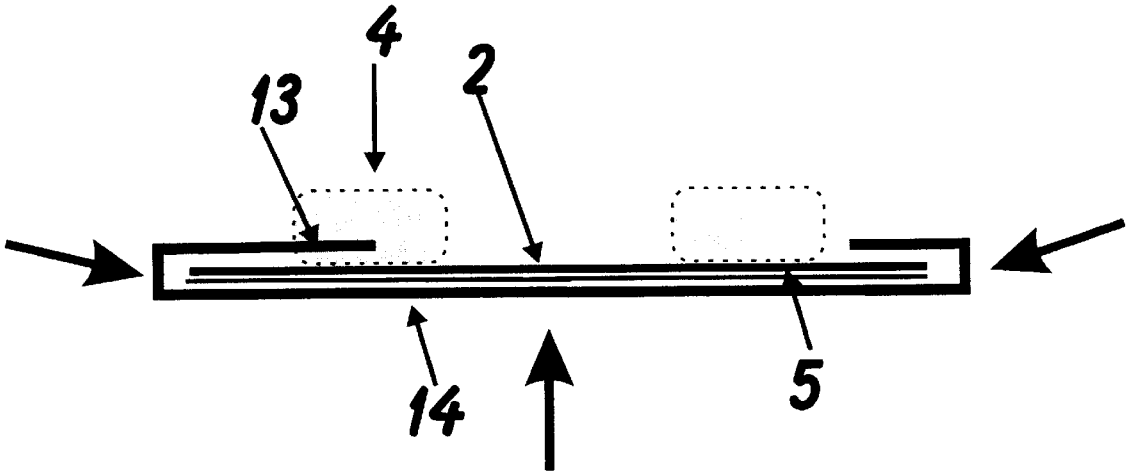
FIG. 6 is diagrammatic transverse sectional view through the assembly of FIG. 4 and taken on a line between the unit doses.
Figure 7:
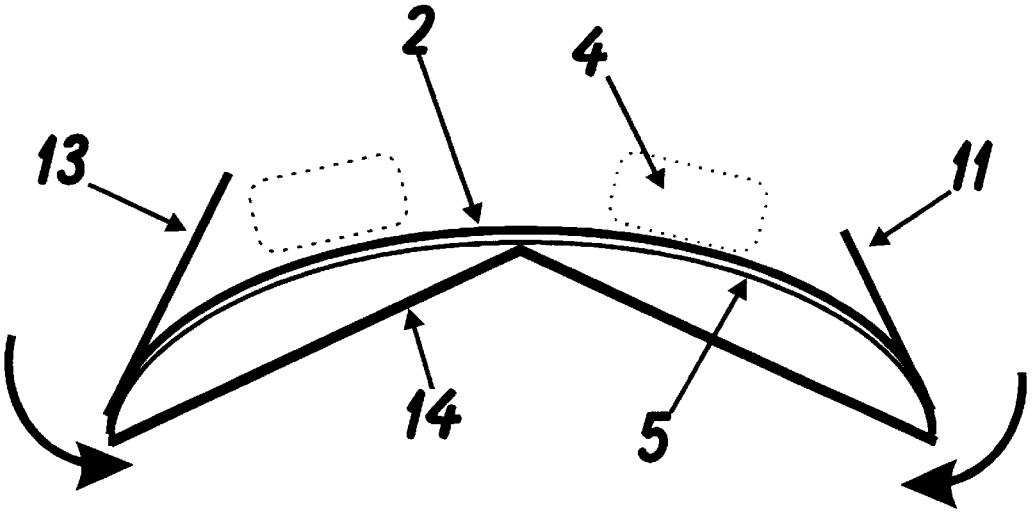
FIG. 7 diagrammatically illustrates the assembly of FIG. 4 in its flexed configuration.

Since the ears 13 between the cut-outs 12 engage the protrusions 3 of the blister pack, relative sliding movement is prevented. Accordingly, dispensing of a unit dose 4 can only be achieved by co-ordinating a combination of actions. By squeezing the opposed longitudinal sides of the sleeve together as indicated by the arrows in FIG. 6, the sleeve and the blister pack adopt a folded or arcuate configuration as shown in FIG. 7 with the flanges 11 of the sleeve deflected away from the sheet 14 and from the protrusions 3 so that the blister pack can be slid at least partially out of the sleeve to allow access to the medicament. Upon removal of the unit dose, the blister pack may be returned back into the sleeve by repeating the above procedure. A C-shaped portion of the planar sheet 14 can be removed at the open end of the sleeve 15 to allow the user to grip the blister pack and slide it out of the sleeve.

Figure 8:
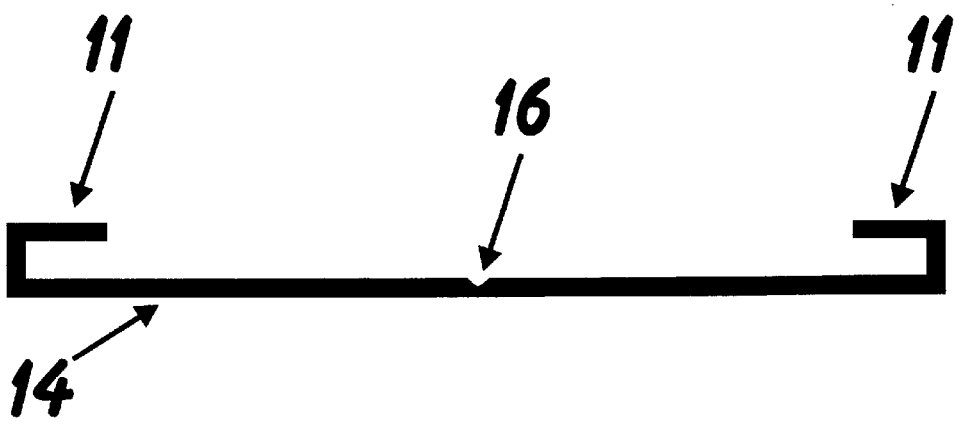
FIG. 8 is a diagrammatic illustration of a sleeve having a fold line.

The planar sheet 14 of the sleeve may also comprise a fold line 16 that runs parallel to the longitudinal sides of the sleeve as shown in FIG. 8. This would bias the sheet 14 against bending in the required direction shown in FIG. 7, thus improving the child resistant properties of the design. Only by inducing the sheet 14 to bend in the correct direction against the fold line whilst squeezing the two sides of the sheet together would the flanges 11 be deflected away from the protrusions 3. One or more fold lines may be present within the sheet 14. Sliding need not be broadly parallel to the longitudinal axis of the pack as is shown in the figures since it may be possible to arrange for an angular or a zig-zag movement. One can envisage such coordinated actions would be difficult for a child to perform.

One of the ways in which children gain access to medicament contained in conventional blister packs is by twisting them. This ruptures the frangible layer, potentially allowing access to several unit doses. The present sleeve 15 reduces the likelihood of this happening as the sleeve adds rigidity to the whole structure. Furthermore if there is rupture while the pack is in the sleeve the medicament will be retained.

Figure 9:
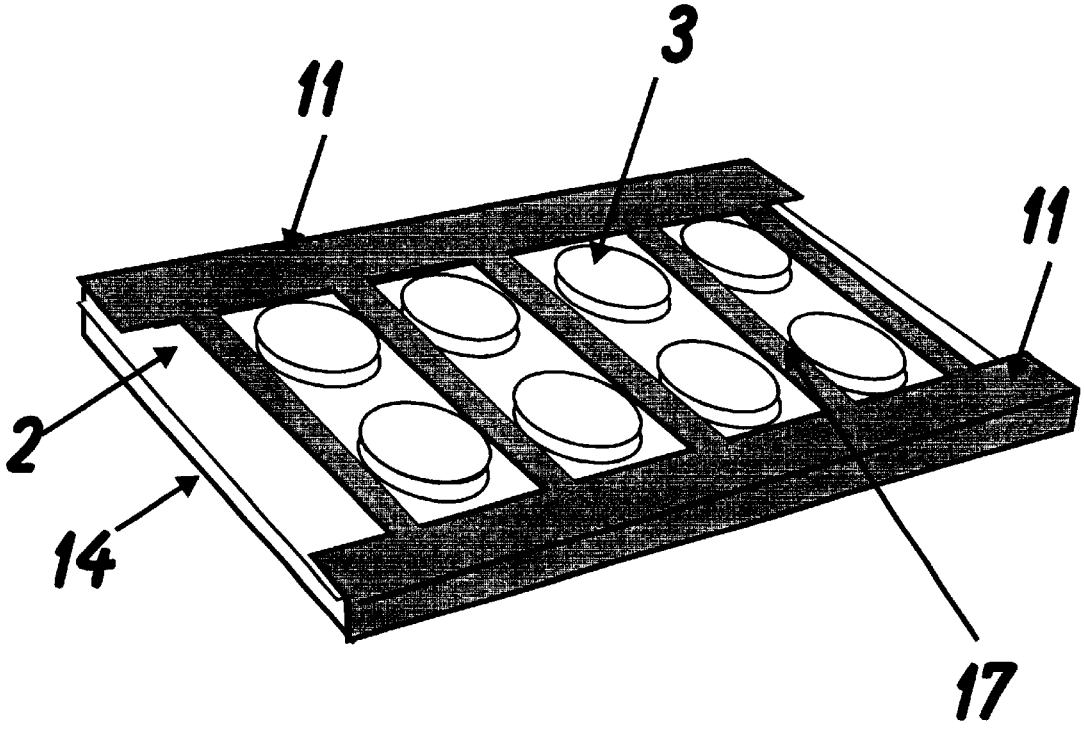
FIG. 9 is a perspective view of one alternative embodiment of a sleeve.

Modification will be apparent to the skilled person. One or more ears or projections may be provided on one or both of the flanges 11. In the alternative embodiment of FIG. 9, the opposed flanges 11 of the sleeve are joined by spaced apart parallel cross bars or parallel continuous projections 17 disposed between adjacent pairs of the unit doses 4. With this arrangement the cross bars 17 are raised into an arcuate configuration permitting passage of the unit doses 4 beneath them when the opposed longitudinal sides of the sleeve are gently squeezed together. The planar member 14 is curved downwardly in the opposite direction. The cross bars may have various shapes, such as a zig-zig shape, to accommodate different patterns of the protrusions on the blister pack.

One or more of the cross bars 17 may be physically attached to the blister pack to prevent sliding movement even when the pack is flexed. In this case the attached bars would have to be torn or otherwise severed before flexing the pack to raise the remaining bars and permit slidable withdrawal of the pack from the sleeve.

A tie wrap (not illustrated) could also be used to prevent all sliding movement, the tie wrap passing around the sleeve either longitudinally or transversely and being removed prior to flexing the sleeve to access the pack. Part of the tie wrap may be attached to the sleeve or to the blister pack so that it has to be detached before being removed.

The sleeve may be transparent. Where transparent the sleeve is particularly useful for use with conventional blister packs where the name and dosage information is printed on the frangible film and will be visible through the sleeve. Portions, especially non-transparent portions, of the sleeve can be provided with indicia. These indicia may comprise patient information of the kind commonly provided on a leaflet included with packaging which is liable to be mislaid.

Further modifications will be apparent to the skilled person. For example the cut-outs and ears could locate on protrusions not containing unit dose. Frangible sheet is not essential: the unit dose could be received in open mouthed cups sealed by the sleeve.

Figure 10:
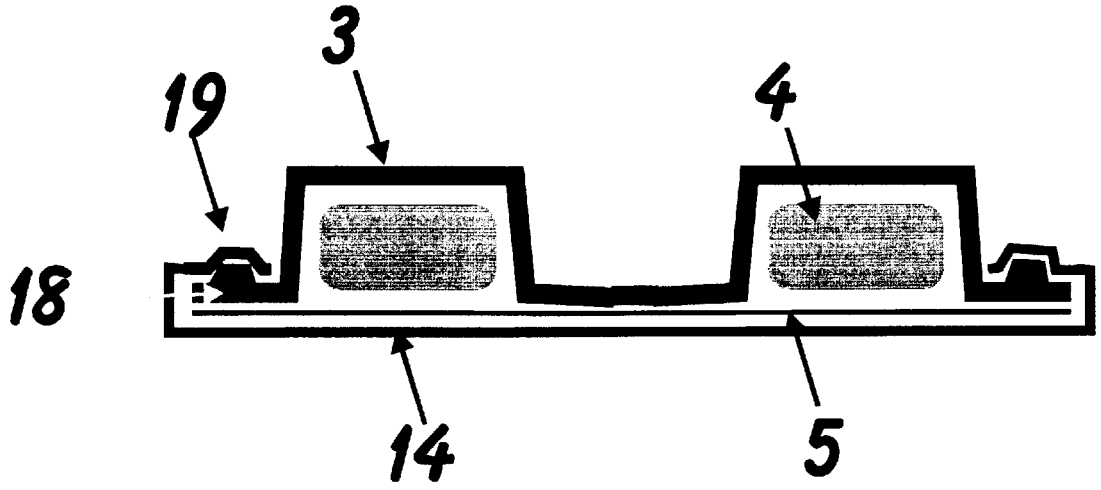
FIG. 10 illustrates diagrammatically a retaining mechanism for maintaining engagement between the sleeve and the blister pack.
Figure 11:
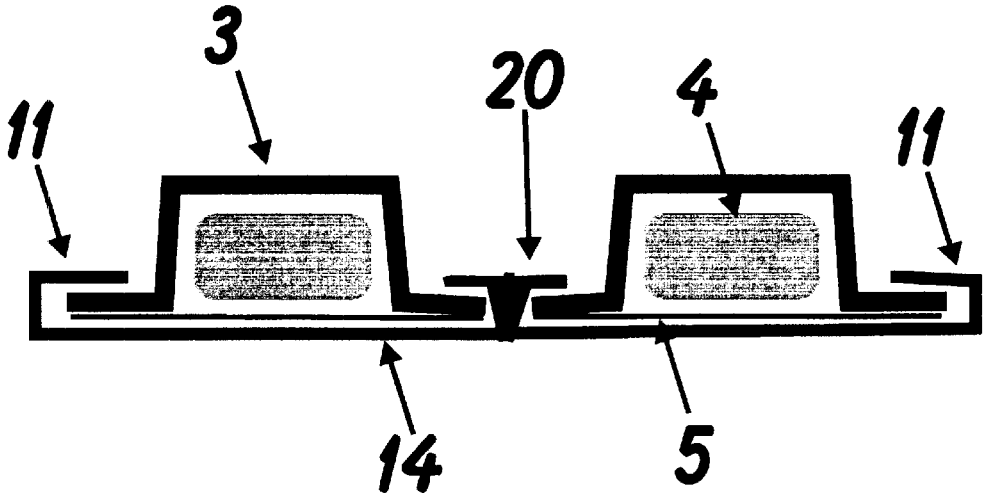
FIG. 11 illustrates diagrammatically an alternative retaining mechanism.

Additional means preventing separation of the blister pack from the sleeve 15 when the sleeve is flexed into or beyond the configuration shown in FIG. 7 may be provided. The skilled person will have no difficulty in devising a suitable retaining mechanism. Examples include detents such as a male portion 18, which may be moulded, of either the pack or the sleeve engaging a female portion 19 of the other of the sleeve and pack, (FIG. 10). The female portion may also be moulded. In another arrangement a T shaped male portion 20 of the sleeve may be received in a groove of the pack, (FIG. 11). In each case the retaining mechanism will allow relative sliding movement between the pack and the sleeve, but will prevent the pack being separated from the sleeve when the sleeve is flexed to the configuration of FIG. 7 or beyond.

Figure 12:
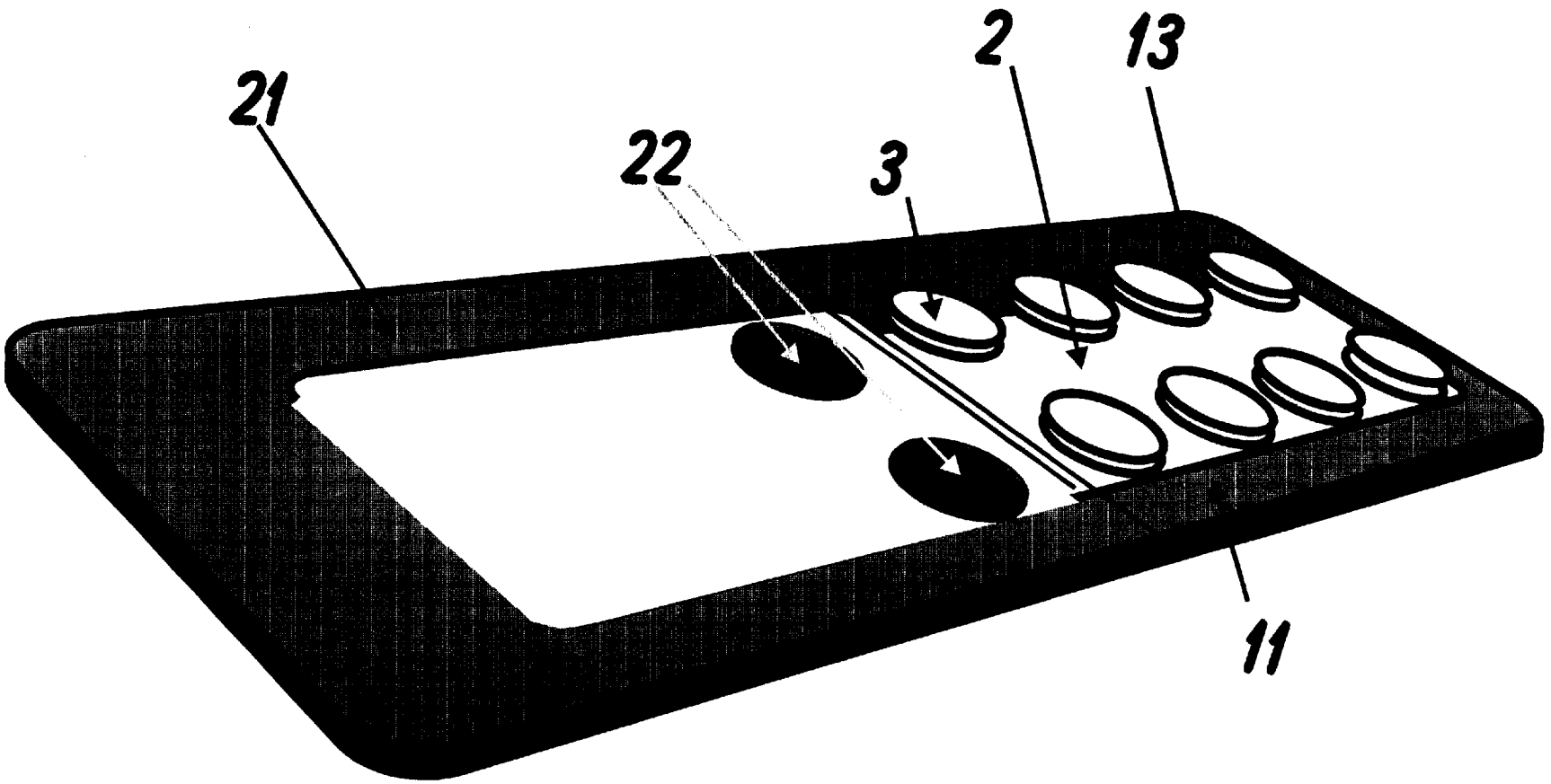
FIG. 12 is a diagrammatic illustration of another embodiment of the invention.

A further modification is shown in FIG. 12. In this embodiment the sleeve is of greater length than the pack. A first portion is as described hereinbefore. A second portion 21 can be provided with a slot into which the pack can be received. One or more but generally a small number such as two holes 22 are provided in the second portion of the sleeve such that medicament can be dispensed. The first and second portions can be joined by a fold line allowing the assembly to be folded for convenient storage. Medicament can then only be dispensed when unit doses overlie the holes in the second portion. This limits the number of unit doses which can be dispensed at one time and then only when the correct alignment has been achieved. This design also provides a larger surface for printing of patient information.

Any of the above features may be used in combination to improve the child resistance or to ensure that only one combination of operations allows the blister pack to be indexed one position, after which another or repeat combination of operations is required to index it further.

What is claimed is:

1. A child-resistant package comprising:

a pack including a plurality of spaced protrusions formed in a sheet and being spaced inwardly from opposed edges of said sheet, a unit dose being contained within at least one of said protrusions, the unit dose being sealed within a chamber formed by said at least one protrusion and being releasable from said chamber through a bottom of said sheet;

a sleeve for slidably receiving said pack, said sleeve including a flexible planar member having a pair of opposed inwardly extending flanges forming opposing slots for receiving the opposed edges of said sheet, said planar member covering said bottom of said sheet preventing the unit dose from being released;

a flexible releasable mechanism preventing slidable removal of said pack from said sleeve, said mechanism being released in response to flexing of said planar member in a predetermined direction and including at least one projection which extends from at least one of said inwardly extending flanges so as to extend between and engage at least one of said spaced protrusions of said pack thus preventing sliding of the pack relative to the sleeve, and said at least one projection being displaced from said at least one protrusion in response to flexing of the planar member in the predetermined direction, thus allowing sliding of said pack relative to said sleeve.

2. The child-resistant package of claim 1, including a plurality of said projections, said plurality of projections extending between a plurality of said protrusions of said pack.

3. The child-resistant package of claim 2 wherein at least one of said inwardly extending flanges of said sleeve includes a plurality of cutouts defining said plurality of projections, each of said projections forming ears extending from said at least one of said inwardly extending flanges and terminating in spaced relationship from the other of said pair of opposed inwardly extending flanges.

4. The child-resistant package of claim 3 wherein each of said inwardly extending flanges includes a plurality of cutouts defining said plurality of projections.

5. The child-resistant package of claim 3 in which at least one of said ears is attached to said sheet whereby said at least one attached ear must be severed from said sheet before flexing the planar member to permit sliding of said pack.

6. The child-resistant package of claim 2 wherein at least one of said plurality of projections is formed as a cross member which extends between said pair of opposed inwardly extending flanges.

7. The child-resistant package of claim 6 wherein said cross member is integrally formed with said opposed inwardly extending flanges.

8. The child-resistant package of claim 6 including a plurality of cross members, each cross member being disposed between said pair of inwardly extending flanges.

9. The child-resistant package of claim 8 wherein said plurality cross members are flexible in an arcuate position by squeezing together opposite sides of said planar member.

10. The child-resistant package of claim 9 in which at least one of said cross members is attached to said sheet whereby said at least one cross member must be severed from said sheet before flexing said planar member to allow sliding of said pack.

11. The child-resistant package of claim 1 including means biasing said planar member against flexing in said predetermined direction.

12. The child-resistant package of claim 11 in which the biasing means comprises at least one fold line extending parallel to said opposed flanges of said planar member.

13. The child-resistant package of claim 1 wherein said pack is a blister pack and said unit dose being sealed in said at least one protrusion by a frangible film.

14. The child-resistant package of claim 1 wherein a transverse flange closes said sleeve at one end thereby preventing slidable removal of said pack through said one end.

15. A child-resistant package comprising:

a pack including a plurality of spaced protrusions formed on a sheet and being spaced inwardly from opposed edges of said sheet, a unit dose being contained within at least one of said protrusions, said unit dose being sealed within a chamber formed by said at least one protrusion and being releasable from said chamber through said sheet;

a sleeve for slidably receiving said pack, said sleeve including a flexible planar member having a pair of opposed inwardly extending flanges forming opposing slots for receiving the opposed edges of said sheet, said planar member covering a bottom of said sheet preventing said unit dose from being released;

a flexible releasable mechanism preventing slidable removal of said pack from said sleeve, said mechanism being released in response to flexing of said planar member in a predetermined direction and including at least two projections which extend from at least one of said inwardly extending flanges so as to extend adjacent at least one of said spaced protrusions of said pack thus preventing sliding of the pack relative to the sleeve, and said at least two projections being displaced from said at least one protrusion in response to the flexing of the planar member in the predetermined direction, thus allowing sliding of said pack relative to said sleeve.

* * * * *